US007437099B2

(12) United States Patent
Ogawa

(10) Patent No.: US 7,437,099 B2
(45) Date of Patent: Oct. 14, 2008

(54) IMAGE FORMING APPARATUS HAVING GEAR MECHANISM FOR ROTATING IMAGE BEARING MEMBER

(75) Inventor: Daisuke Ogawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 322 days.

(21) Appl. No.: 11/419,612

(22) Filed: May 22, 2006

(65) Prior Publication Data

US 2006/0263114 A1 Nov. 23, 2006

(30) Foreign Application Priority Data

May 20, 2005 (JP) ..... 2005-148630

(51) Int. Cl.
*G03G 15/00* (2006.01)

(52) U.S. Cl. ..... 399/167

(58) Field of Classification Search ..... 399/91, 399/167

See application file for complete search history.

(56) References Cited

U.S. PATENT DOCUMENTS 5,272,506 A 12/1993 Goto et al.
5,463,450 A 10/1995 Inoue et al.
5,905,927 A * 5/1999 Inoue et al. ..... 399/167
6,142,690 A 11/2000 Yoshimura et al.
6,466,752 B2 10/2002 Tsunoda
2004/0133404 A1 7/2004 Kiwamu et al.

FOREIGN PATENT DOCUMENTS

| | | |
|---|---|---|
| JP | H535050 | 2/1993 |
| JP | H535051 | 2/1993 |
| JP | H10312097 | 11/1998 |
| JP | 2002139959 | 5/2002 |
| JP | 2002202699 | 7/2002 |
| JP | 2004133809 | 4/2004 |
| JP | 2004177615 | 6/2004 |

* cited by examiner

*Primary Examiner*—William J Royer
(74) *Attorney, Agent, or Firm*—Baker Botts L.L.P.

(57) ABSTRACT

A driving unit of an image forming apparatus is configured in such a manner that an engagement noise frequency is larger than an image-quality assurance frequency and that the engagement noise frequency is less than or equal to an upper limit frequency of a one-third octave band frequency range including the image-quality assurance frequency. The image-quality assurance frequency is defined as a frequency obtained by multiplying a conveying speed of a recording medium by a value of 1.6, and the engagement noise frequency is defined as a frequency obtained by multiplying a predetermined number of teeth of a first gear by a rotational speed of a motor, when a unit of the conveying speed of the recording medium is millimeters per second, a unit of the value of 1.6 is cycles per millimeter, and a unit of the rotational speed of the motor is revolutions per second.

8 Claims, 4 Drawing Sheets

IMAGE FORMING APPARATUS HAVING GEAR MECHANISM FOR ROTATING IMAGE BEARING MEMBER

CROSS REFERENCE TO RELATED APPLICATIONS

This application claims priority from Japanese Patent Application. No. 2005-148630 filed May 20, 2005, The entire content of the priority application is incorporated herein by reference.

TECHNICAL FIELD

The disclosure relates to an image forming apparatus, and more particularly to an electrophotography-type image forming apparatus.

BACKGROUND

An image forming apparatus of the electrophotography type such as a laser printer forms images on recording mediums such as papers or OHP sheets by rotating a photosensitive drum to transfer toner adhering to a circumferential surface thereof to the recording mediums.

Accordingly, when transferring toner to a recording medium, in case the photosensitive drum does not rotate at a constant speed with respect to the recording medium, there is undesirably raised image defects such as periodical white stripes and dark stripes in a conveying direction of the recording medium.

In the following explanation, such record defect is referred to as banding, and a state in which the photosensitive drum does not rotate at a constant speed with respect to a recording medium is referred to as rotational irregularity of the photosensitive drum.

The rotational irregularity of the photosensitive drum is caused mainly by deteriorated precision of gears for rotating the photosensitive drum, such as single pitch error, pitch variation, normal pitch error, and tooth profile error of gears. The single pitch error, pitch variation, normal pitch error, and tooth profile error are prescribed by JIS (Japanese Industrial Standards) B 1702.

That is, since gears transmit rotational forces when the gears are rotated and teeth are engaged with teeth of another gear one after another, a load applied to each tooth fluctuates when the teeth are engaged one after another, and the load fluctuation causes the rotational irregularity.

Accordingly, when there are concurrently causes that distances between teeth are not constant and that tooth profiles are not precise, rotational motion cannot be transmitted accurately. Thus, the load fluctuation becomes significantly large when the teeth are engaged one after another. Therefore, instantaneous large rotational irregularity is generated. Hence, low precision of teeth causes banding having a cycle of the teeth of the gears.

When gears with high precision are used, the rotational irregularity can be reduced, and also the banding can be reduced. On the other hand, since gears transmit a rotational force when the teeth are engaged one after another, it is difficult to completely remove the rotational irregularity generated when the teeth are engaged one after another.

U.S. Pat. No. 6,142,690 (corresponding to Japanese Patent Application Publication No. HEI-10-312097) discloses increasing the number of teeth of gears configuring a gear mechanism to reduce intervals between bandings so that the banding cannot be easily recognized.

When the number of teeth of gears for rotating the photosensitive drum is increased, the number of teeth of gear which is rotated while a recording medium is conveyed by a unit length is also increased. Hence, teeth of a gear switch engagement with teeth of another gear in a shorter period (i.e., switching period becomes shorter and switching frequency becomes higher), making the banding less clearly recognized.

SUMMARY

Generally, the number of teeth of a gear which rotates daring a period of time in which a recording medium is conveyed by a unit length is equal to a value obtained by dividing a product of the number of teeth of the gear and a rotational speed of the gear (revolutions per second) by a conveying speed of the recording medium (millimeters per second). This value is hereinafter referred to as spatial frequency.

The larger the spatial frequency becomes, the smaller the spacing between stripes becomes, and adjacent stripes cannot be recognized by the naked eye, which makes the banding inconspicuous. On the other hard, the smaller the spatial frequency becomes, the larger the spacing between stripes becomes, and adjacent stripes can be easily recognized by the naked eye, which makes the banding conspicuous. As described above, the main cause of the banding is the periodical switch of engaged teeth of gears that rotates the photosensitive drum. Further, the spatial frequency is substantially equal to the number of teeth which are rotated during a period of time in which a recording medium is conveyed by a unit length (normally, 1 millimeter).

As described above, the banding becomes inconspicuous when the number of teeth of the gear that rotates the photosensitive drum is increased However, since the number of times of crash between the teeth when the gear rotates increases, noise frequency becomes higher.

On the other hand, as is well known, when hearing a sound of the same intensity, a person feels the sound smaller when the frequency is lower, while he feels the sound larger (harsher) when the frequency is higher. Thus, when the number of teeth of the gear that rotates the photosensitive drum is increased, harsh-sounding high frequency noise increases.

To solve this problem, if the rotational speed of the gear is lowered by at least increased number of teeth of the gear, the number of times of crash between teeth during a unit time period is decreased. Therefore, the spatial frequency can be increased to improve the printing quality, and the noise frequency can be prevented from being increased. However, the conveying speed of the recording medium is decreased, which lowers the printing speed.

To cope with the problem that the conveying speed of the recording medium is decreased, a reduction ratio of a gear mechanism (reduction mechanism, can be reduced. In this case, the conveying speed is maintained and concurrently the printing quality is improved as well as the noise is reduced. However, a drive torque is increased if the reduction ratio is decreased. Thus, the size of a motor has to be increased, and forces exerted or surfaces of teeth of gears become large, leading to difficulty in designing gears.

In view of the foregoing, it is ar object of one aspect of the invention to provide an image forming apparatus that can improve printing quality and also reduce noise without significantly decreasing a conveying speed of a recording medium.

In order to attain the above and other objects, the invention may provide an image forming apparatus. The image forming apparatus includes an image forming unit, a conveying unit, and a driving unit. The image forming unit forms an image on a recording medium. The image forming unit includes an image bearing member. The conveying unit conveys the recording medium at a conveying speed. The driving unit rotates the image bearing member. The driving unit includes a motor, a first gear, and a second gear. The motor has a rotation shaft and generates a rotational force for rotating the rotation shaft at a rotational speed. The first gear rotates integrally with the rotation shaft. The first gear has a predetermined number of teeth. The second gear is engaged with the first gear. The driving unit is configured in such a manner that an engagement noise frequency is larger than an image-quality assurance frequency and that the engagement noise frequency is less than or equal to an upper limit frequency of a one-third octave band frequency range including the image-quality assurance frequency. The image-quality assurance frequency is defined as a frequency obtained by multiplying the conveying speed of the recording medium by a value of 1.6, and the engagement noise frequency is defined as a frequency obtained by multiplying the predetermined number of teeth of the first gear by the rotational speed of the motor, when a unit of the conveying speed of the recording medium is millimeters per second, a unit of the value of 1.6 is cycles per millimeter, and a unit of the rotational speed of the motor is revolutions per second.

BRIEF DESCRIPTION OF THE DRAWINGS

Illustrative aspects in accordance with the invention will be described in detail with reference to the following figures wherein.

DETAILED DESCRIPTION

An image forming apparatus according to some aspects of the invention will be described while referring to the accompanying drawings.

In the following description, the expressions "front", "rear", "upper", and "lower" are used to define the various parts when the image forming apparatus is disposed in an orientation in which it is intended to be used,

1. Entire Configuration of Laser Printer

Figure 1:
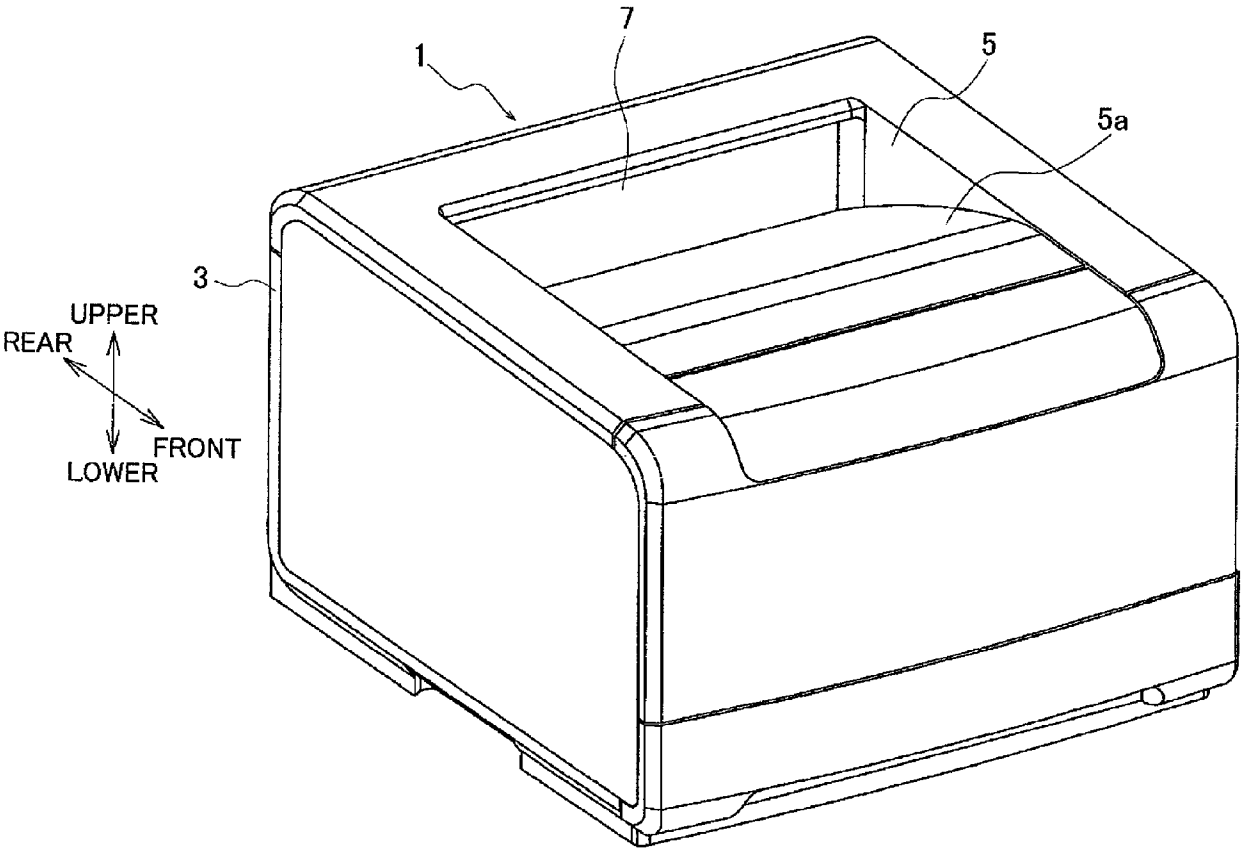
FIG. 1 is a perspective view showing an external appearance of a laser printer according to illustrative aspects of the invention.

FIG. 1 is a perspective view showing an external appearance of a laser printer 1 according to illustrative aspects of the invention. The laser printer 1 is normally disposed with a top side facing in the upward direction and with a front side facing in the forward direction, as shown by the arrows.

The laser printer 1 has a casing 3 substantially in a form of a box (rectangular parallelepiped). On the top side of the casing 3, a sheet discharge tray 5 is provided on which a recording medium is discharged from inside the casing 3 after printing. For example, paper sheets or OHP sheets are used as recording mediums.

The sheet discharge tray 5 has a sloped surface 5*a* which is inclined downward from the front side of the casing 3 to the tear side thereof. A discharge portion 7 for discharging a recording medium on which images are printed is formed at the rear end of the sloped surface 5*a*.

2. Internal Configuration of Laser Printer

Figure 2:
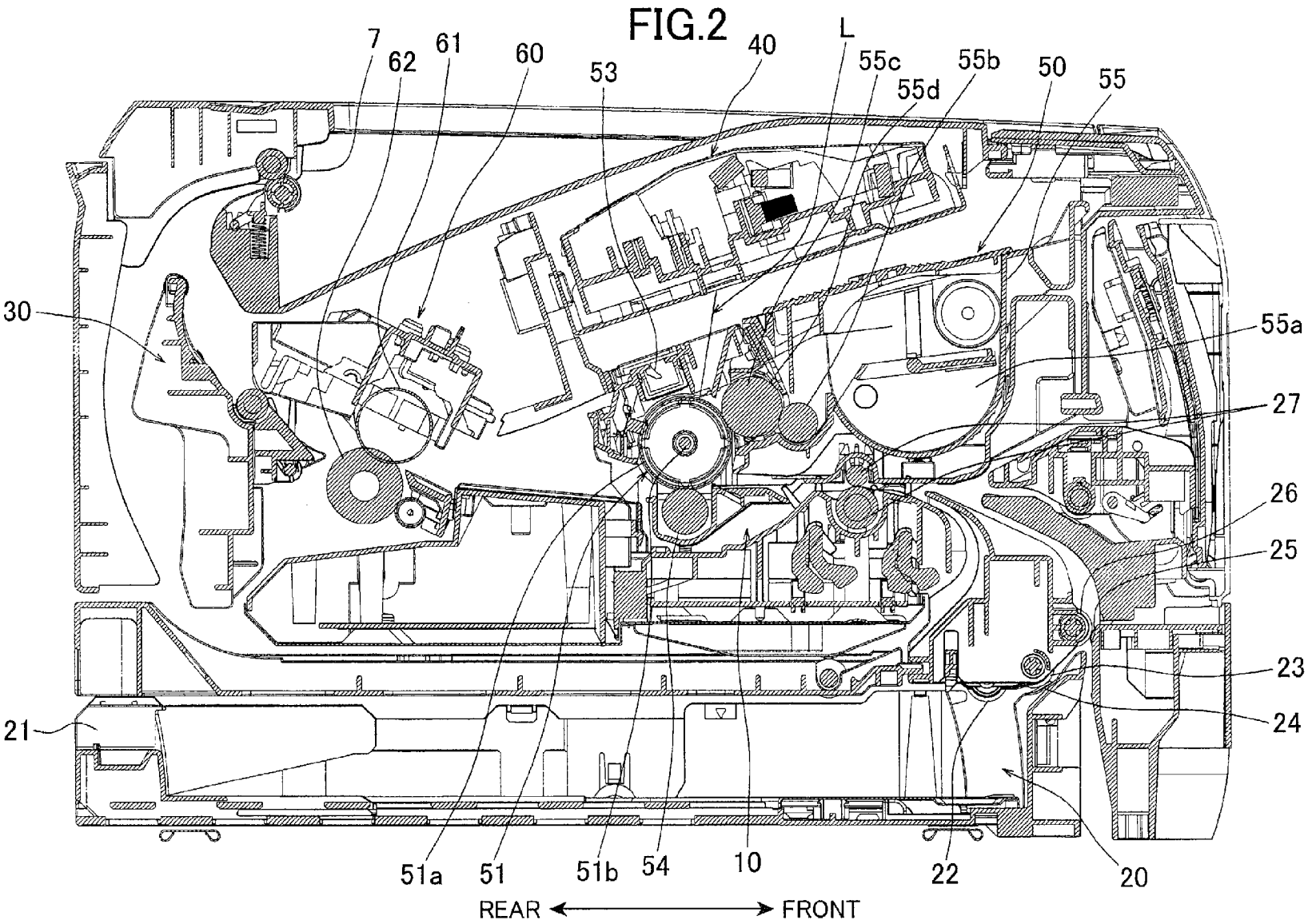
FIG. 2 is a vertical cross-sectional view of relevant parts of the laser printer shown in FIG. 1.

FIG. 2 is a vertical cross-sectional view of relevant parts of the laser printer 1. The casing 3 houses therein an image forming unit 10 for forming images on recording mediums, a feeder unit 20 that serves as a feeding means for supplying recording mediums to the image forming unit 10, and a discharge chute 30 that serves as a guiding member for guiding recording mediums on which images are printed in the image forming unit 10 to the discharge portion 7.

2.1 Feeder Unit

The feeder unit 20 has a paper feed tray 21 that is disposed at the lowermost part of the casing 3, a paper feed roller 22 that is disposed near the front upper end of the paper feed tray 21 and feeds recording mediums to the image forming unit 10, a separation roller 23 for separating recording mediums fed by the paper feed roller 22 one sheet at a time, a separation pad 24, and the like. Then, recording medium positioned in the paper feed tray 21 turns at the front side in the casing 3 to be conveyed to the image forming unit 10 located substantially at the center of the casing 3.

A conveying path is provided from the paper feed tray 21 to the image forming unit 10. A paper powder removing roller 25 is disposed at the outside of a turning point where a recording medium turns. The paper powder removing roller 25 removes paper powders adhering to the image forming surface (printing surface) of a recording medium. A confronting roller 26 is disposed at the inside of the turning point for urging a fed recording medium to the paper powder removing roller 25.

In the conveying path, registration rollers 27 are disposed at an entrance of the image forming unit 10. The registration rollers 27 are a pair of rollers for applying feed resistance to a recording medium to adjust a conveying state of the recording medium.

2.2 Image Forming Unit

The image forming unit 10 serves as an image forming means of the electrophotography-type image forming apparatus The image forming unit 10 includes a scanner unit 40, a process cartridge 50, a fixing unit 60, and the like.

2.2.1 Scanner Unit

The scanner unit 40 is disposed at the upper portion of the casing 3, and forms an electrostatic latent image on the surface of a photosensitive drum 51 to be described later. The scanner unit 40 includes a laser light source (not shown), a polygon mirror (not shown), an fθ lens (not shown), reflecting mirrors (not shown), and the like.

A laser beam L based on image data emitted from the laser light source is deflected by the polygon mirror, turned by a reflecting mirror after passing through the fθ lens, and deflected downward by a reflecting mirror to be irradiated on the surface of the photosensitive drum 51, thereby forming an electrostatic latent image.

2.2.2 Process Cartridge

The process cartridge 50 is detachably disposed within the casing 3 at the lower side of the scanner unit 40. The process cartridge 50 includes the photosensitive drum 51, a charger 53, a transfer roller 54, a development cartridge 55, and the like.

The photosensitive drum 51 serves as an image bearing member that bears an image to be transferred onto a recording medium. The photosensitive drum 51 has a drum main body 51*a* in a form of a cylinder with the uppermost layer formed by a positively-charged photosensitive layer such as polycarbonate, and a drum shaft 51*b* that extends in a longitudinal direction of the drum main body 51*a* at an axial center of the drum main body 51*a* and rotatably supports the drum main body 51*a*.

Figure 3B:
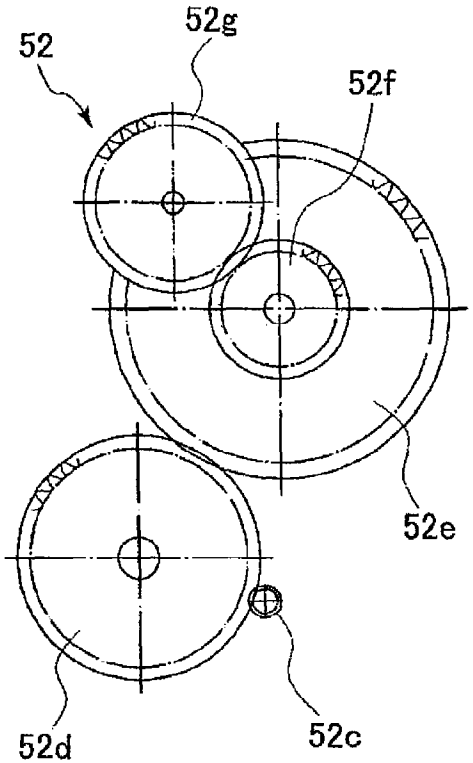
FIG. 3B is a schematic view of the reduction mechanism shown in FIG. 3A.
Figure 3A:
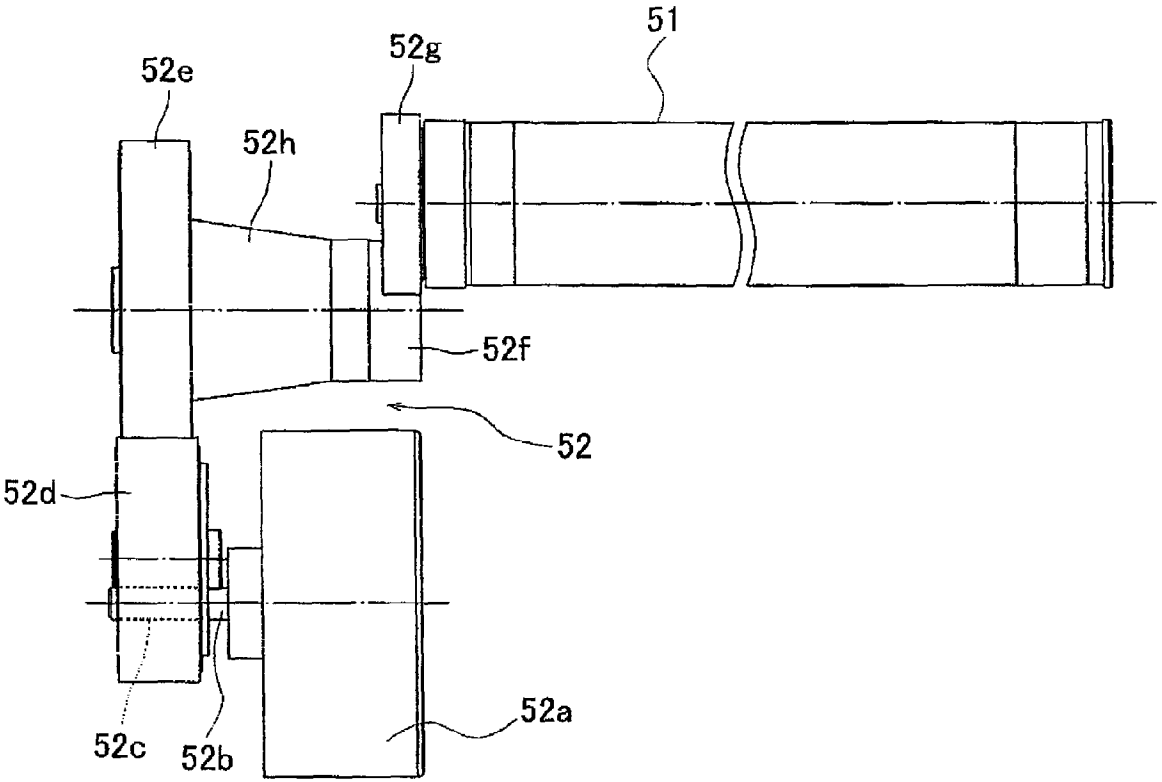
FIG. 3A is an enlarged view showing an arrangement of a Photosensitive drum and a reduction mechanism.

As shown in FIGS. 3A and 3B, the photosensitive drum 51 is driven to be rotated by an electric motor 52*a* through a reduction mechanism 52. The reduction mechanism 52 includes a first gear 52*c*, a second gear 52*d*, and other gears 52*e*, 52*f*, and 52*g*. As shown in FIG. 3A, the first gear 52*c* is provided at an end portion of a rotation shaft 52*b* of the electric motor 52*a*, and rotates integrally with the rotation shaft 52*b*. The gears 52*e* and 52*f* are provided on both end portions of a gear member 52*h*. The gear 52*g* is provided at ar end portion of the photosensitive drum 51, and rotates integrally with the photosensitive drum 51. As shown in FIGS. 3A and 3B, the second gear 52*d* engages with both the first gear 52*c* and the gear 52*e* The gear 52*f* engages with the gear 52*g*. With this configuration, the reduction mechanism 52 can transmit a rotational force generated ty the electric motor 52*a* to the photosensitive drum 51. In the illustrative aspects, the reduction mechanism 52 and the electric motor 52*a* constitute a driving unit that rotates the photosensitive drum 51.

Figure 4:
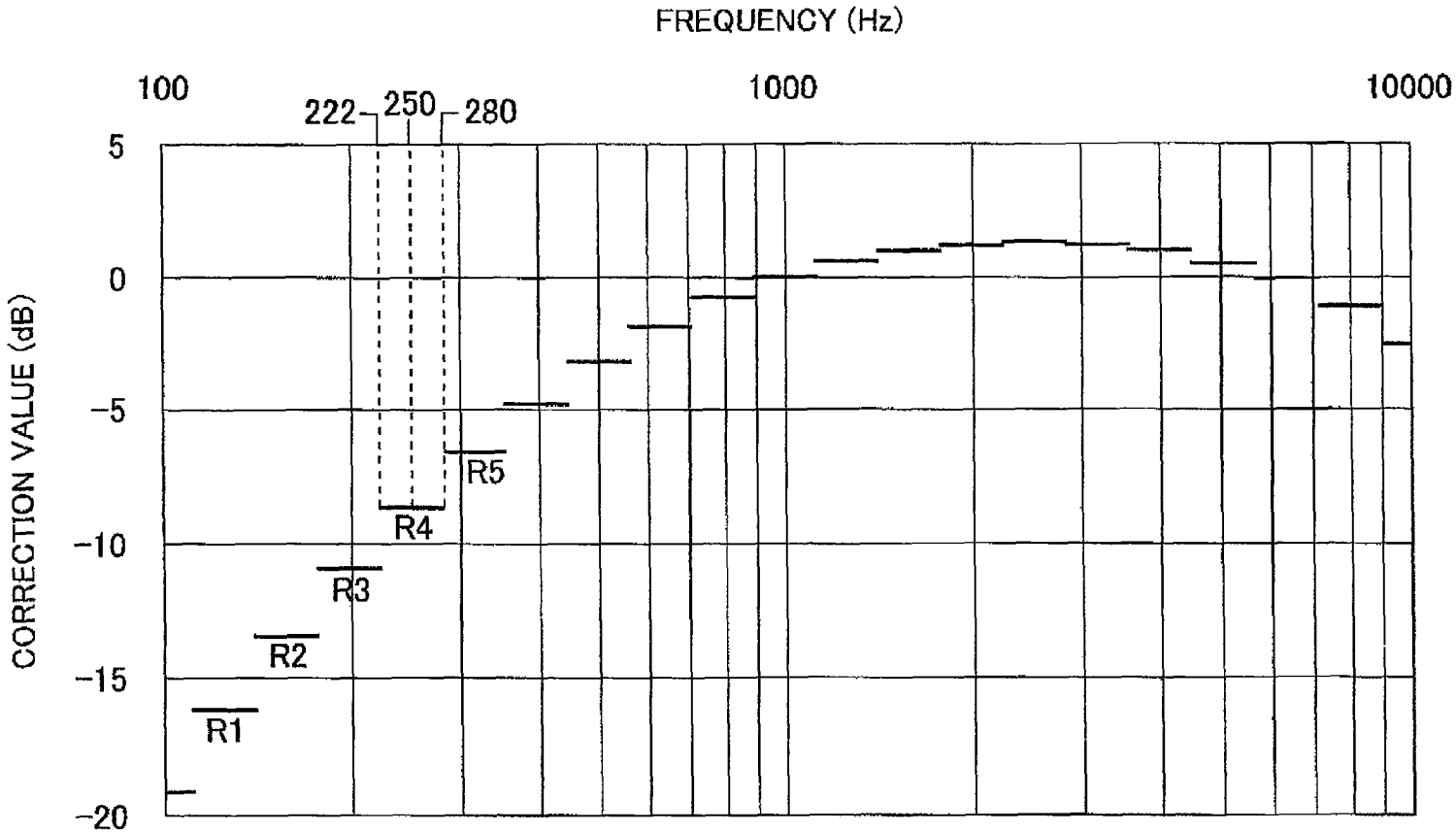
FIG. 4 is a graphical representation of an A characteristic curve.

In the illustrative aspects, a number of teeth of the first gear 52*c* and a rotational speed of the electric motor 52*a* (revolutions/second) are set such that an engagement noise frequency is larger than an image-quality assurance frequency and that the engagement noise frequency is less than or equal to an upper limit frequency of a ⅓ octave band frequency range including the image-quality assurance frequency. Here, the engagement noise frequency is a frequency obtained by multiplying the number of teeth of the first gear 52*c* by the rotational speed of the electric motor 52*a*. The image-quality assurance frequency is a frequency obtained by multiplying a conveying speed of a recording medium (mm/second) by a value of 1.6 (cycles/mm). The value of 1.6 (cycles/mm) is spatial frequency indicative of a lower limit of allowable image quality, As shown in FIG. 4, the ⅓ octave band frequency range is each frequency range R1-R5 and so on, each having a ⅓ octave band, Generally, noise values (noise levels) are corrected using an A characteristic curve (refer to JIS Z 8734, JIS C 1514, and the like), and the noise values in the same ⅓ octave band frequency range is corrected using the same correction value (refer to JIS Z 8734 and the like). In FIG. 4, the A characteristic curve is in a form of steps, each step having a ⅓ octave band frequency range. That is, each level part of the steps (each frequency range R1-R5 etc.) means that a same correction value is used for correcting noise values within each ⅓ octave band frequency range.

In the illustrative aspects, the first gear 52*c* employs a helical gear which has a number of teeth equal to 8 or 9 and has a module of 0.5. A total contact ratio between the first gear 52*c* and the second gear 52*d* is greater than or equal to 4. Further, the rotational speed of the electric motor 52*a* is set such that the ⅓ octave band frequency range including the image-quality assurance frequency has a center frequency of 250 Hz (hertz)

For example, when the laser printer 1 is capable of printing approximately 28 recording mediums of A4 size in one minute, the conveying speed of the recording medium is approximately 165 mm/second. Hence, the image-quality assurance frequency is approximately 265 Hz (=165 mm/second multiplied by 1.6 cycles/mm). As shown in FIG. 4, the image-quality assurance frequency of 265 Hz is included in the frequency range R4. The frequency range R4 has a lower limit frequency of 222 Hz, a center frequency of 250 Hz, and an upper limit frequency of 280 Hz. Accordingly, in this example, the engagement noise frequency is set to be larger than the image-quality assurance frequency (265 Hz) and is less than or equal to the upper limit frequency (280 Hz) of the ⅓ octave band frequency range R4 including the image-quality assurance frequency (265 Hz). Thus, the engagement noise frequency can be set to 265 to 270 Hz or larger (but less than or equal to 220 Hz), for example.

The charger 53 is an electrical charging unit that electrically charges the surface of the photosensitive drum 51. The charger 53 is disposed at the rear upper side of the photosensitive drum 51 and confronts the photosensitive drum 51 without contacting the photosensitive drum 51 with a predetermined space therebetween, as shown in FIG. 2. The charger 53 in the illustrative aspects employs a scorotron charger that positively charges the surface of the photosensitive drum 51 substantially uniformly by using corona discharge The transfer roller 54 is so disposed as to confront the photosensitive drum 51 and rotates in conjunction with rotation of the photosensitive drum 51. The transfer roller 54 is a transfer unit that transfers toner adhering to the surface of the photosensitive drum 51 to a printing surface of a recording medium by applying electric charge to the recording medium from the opposite side of the printing surface when the recording medium passes near the photosensitive drum 51. The electric charge applied here is negative charge in the illustrative aspects, which is an opposite charge to that on the photosensitive drum 51.

The development cartridge 55 has a toner container 55*a* that contains toner, a toner supplying roller 55*b* that supplies toner to the photosensitive drum 51, a development roller 55*c*, and the like.

Toner contained in the toner container 55*a* is supplied to the development roller 55*c* when the toner supplying roller 55*b* is rotated, then the toner supplied to the development roller 55*c* is borne on the surface of the development roller 55*c*, and the thickness of the toner is adjusted by a layer thickness regulation blade 55*d* such that the thickness becomes constant (uniform) at a predetermined thickness, Then, the toner is supplied to the surface of the photosensitive drum 51 exposed by the scanner unit 40.

2.2.3 Fixing Unit

The fixing unit 60 is disposed at the downstream side of the photosensitive drum 51 in the conveying direction of a recording medium. The fixing unit 60 fixes toner transferred to the recording medium by heating and fusing the tone. Specifically, the fixing unit 60 includes a heating roller 61 that is disposed on the printing surface side of a recording medium and heats the toner, and a pressure roller 62 which is disposed at the opposite side of the heating, roller 61 to press the recording medium to the heating roller 61 side.

The heating roller 61 in the illustrative aspects has a metal pipe that has a surface coated with fluorocarbon resin, and a halogen lamp disposed in the metal pipe for heating. On the other hand, the pressure roller 62 has a metal roller shaft and a roller made of rubber material covering the metal roller shaft.

The above-described image forming unit 10 forms images on a recording medium as described below.

That is, the surface of the photosensitive drum 51 is positively charged uniformly by the charger 53 when rotating, and is exposed to a laser beam irradiated by the scanner unit 40 in a high-speed scanning motion. Accordingly, electrostatic latent images corresponding to images to be formed on a recording medium are formed on the surface of the photosensitive drum 51.

Next, upon rotation of the development roller 55*c*, when the toner borne on the development roller 55*c* and positively charged confronts and comes into contact with the photosensitive drum 51, the toner is supplied to a portion of the surface of the photosensitive drum 51 which has been exposed to a laser beam and whose electric potential is lowered (an electrostatic latent image). Thus, the electrostatic latent image of the photosensitive drum 51 is made visible, and a toner image in reversal development is borne on the surface of the photosensitive drum 51.

Then, the toner image borne on the surface of the photosensitive drum 51 is transferred to a recording medium by a transfer bias applied to the transfer roller 54. Then, the recording medium on which the toner image is transferred is conveyed to the fixing unit 60 to be heated, and toner transferred as the toner image is fixed to the recording medium, completing the image forming operation.

3. Characteristics of Laser Printer According to the Illustrative Aspects

Since a primary cause of noise is crash sound between teeth of gears, the frequency of sound which a person hears as noise is represented by a product of a number of teeth of a gear and a rotational speed of the gear, that is, the engagement noise frequency as described above Further, since ears of a person feel sound larger (harsher) when the frequency is higher, a gear that rotates at a highest speed generates noise of a highest frequency and thus generates a largest (harshest) sound.

Accordingly, the engagement noise frequency of the first gear 52*c* that rotates integrally with the rotation shaft 52*b* of the electric motor 52*a* is a highest frequency and thus generates a harshest noise for a person.

Further, as described above, when hearing a sound of a same intensity, ears of a person feel the sound smaller when the frequency is lower, while he feels the sound larger (harsher) when the frequency is higher. Accordingly, a noise level is generally evaluated by correcting absolute measurement values of sound pressure level using the A characteristic curve (refer to JIS X 7779, JIS Z 8734, JIS C 1514, and the like) as described above.

Further, when correcting the absolute measurement values of sound pressure level, the entire frequency range is divided every ⅓ octave band, and in each ⅓ octave band frequency range, the absolute measurement values are corrected using a same correction value (refer to JIS Z 8734 and FIG. 4).

Accordingly, in the illustrative aspects, the engagement noise frequency is larger than the image-quality assurance frequency and is less than or equal to an upper limit frequency of a ⅓ octave band frequency range including the image-quality assurance frequency Hence, the number of teeth of the first gear 52*c* and the rotational speed of the electric motor 52*a* can be increased within a range in which absolute measurement values are corrected using a same correction value and a person hears noise as a noise of substantially a same degree, that is, within the ⅓ octave band frequency range.

Accordingly, the spatial frequency can be increased without increasing noise that a person feels, thereby improving printing quality and suppressing the noise without significantly decreasing a conveying speed of a recording medium. In other words, an appropriate balance is achieved among noise suppression, printing quality, and printing speed. In the above-described example, the laser printer 1 is capable of printing approximately 28 recording mediums of A4 size in one minute, and the engagement noise frequency is set to 265 to 270 Hz or larger (but less than or equal to 280 Hz).

Further, in the illustrative aspects, since helical gears are used as gears constituting the reduction mechanism 52 and the total contact ratio between the first gear 52*c* and the second gear 52*d* is greater than or equal to 4, noise generated in the reduction mechanism 52 can be lowered, and rotational irregularity that occurs when teeth are engaged one after another can be reduced.

While the invention has been described in detail with reference to the above aspects thereof, it would be apparent to those skilled in the art that various changes and modifications may be made therein without departing from the spirit of the invention.

In the above-described illustrative aspects, a laser printer is described as an example of an image forming apparatus. However, the invention is not limited to a laser printer, and may be applied to a copying machine or the like.

Further, the gears constituting the reduction mechanism 52 is not limited to those shown in the illustrative aspects, and other gears may be used.

Moreover, helical gears are used in the illustrative aspects. However, the invention is not limited to helical gears, and spur gears or other types of gears may be used.

What is claimed is:

1. An image forming apparatus comprising:

an image forming unit that forms an image on a recording medium, the image forming unit including an image bearing member;

a conveying unit that conveys the recording medium at a conveying speed; and a driving unit that rotates the image bearing member, the driving unit including:

a motor having a rotation shaft and generating a rotational force for rotating the rotation shaft at a rotational speed;

a first gear that rotates integrally with the rotation shaft, the first gear having a predetermined number of teeth; and a second gear engaged with the first gear;

wherein the driving unit is configured in such a manner that an engagement noise frequency is larger than an image-quality assurance frequency and that the engagement noise frequency is less than or equal to an upper limit frequency of a one-third octave band frequency range including the image-quality assurance frequency; and wherein the image-quality assurance frequency is defined as a frequency obtained by multiplying the conveying speed of the recording medium by a value of 1.6, and the engagement noise frequency is defined as a frequency obtained by multiplying the predetermined number of teeth of the first gear by the rotational speed of the motor, when a unit of the conveying speed of the recording medium is millimeters per second, a unit of the value of 1.6 is cycles per millimeter, and a unit of the rotational speed of the motor is revolutions per second.

2. The image forming apparatus according to claim 1, wherein the one-third octave band frequency range including the image-quality assurance frequency has a center frequency of 250 hertz.

3. The image forming apparatus according to claim 1, wherein the predetermined number of teeth of the first gear is either eight or nine.

4. The image forming apparatus according to claim 1, wherein the first gear has a module of 0.5.

5. The image forming apparatus according to claim 1, wherein the first gear and the second gear are helical gears; and wherein a total contact ratio between the first gear and the second gear is greater than or equal to four.

6. The image forming apparatus according to claim 1, wherein the image bearing member is a photosensitive drum.

7. The image forming apparatus according to claim 1, wherein the image forming apparatus includes a single photosensitive drum serving as the image bearing member.

8. The image forming apparatus according to claim 1, wherein the driving unit includes a reduction mechanism, the reduction mechanism including the first gear and the second gear.

* * * * *